US005890297A

United States Patent [19]

Frasheski

[11] Patent Number: 5,890,297

[45] Date of Patent: Apr. 6, 1999

[54] DOOR-SET DEVICE

[76] Inventor: Quentin Frasheski, 17033 High Pine Way, Castro Valley, Calif. 94546

[21] Appl. No.: 922,262

[22] Filed: Sep. 2, 1997

Related U.S. Application Data

[63] Continuation of Ser. No. 748,030, Nov. 12, 1996.

[51] Int. Cl.[6] ..... E04F 21/00

[52] U.S. Cl. ..... 33/194; 52/213; 49/380

[58] Field of Search ..... 33/194, 645; 52/213, 52/217, 745.15, 745.16; 49/380; 269/905

[56] References Cited

U.S. PATENT DOCUMENTS

| | | | |
|---|---|---|---|
| 880,252 | 2/1908 | Tennent | 33/194 |
| 948,849 | 2/1910 | Ehr | 33/194 |
| 3,189,137 | 6/1965 | Harris | 52/213 |
| 3,930,738 | 1/1976 | Thuss et al. | 52/217 |
| 4,014,146 | 3/1977 | DiMascio et al. | 52/217 |
| 4,840,002 | 6/1989 | Lovgren | 52/213 |
| 4,947,594 | 8/1990 | Theobald et al. | 33/194 |
| 5,590,496 | 1/1997 | Martin et al. | 52/213 |

FOREIGN PATENT DOCUMENTS

| | | | |
|---|---|---|---|
| 2332086 | 1/1975 | Germany | 52/213 |

*Primary Examiner*—Thomas B. Will
*Attorney, Agent, or Firm*—Linval B. Castle

[57] ABSTRACT

A small expendable device for accurately and very quickly adjusting the verticality of door jambs without shingles or other shims. The device includes a body member which is attached to the rough wall opening and a carriage member which is attached to the door jamb and which is slideable in tracks across the body member. A Phillips screwdriver is placed in a tapered hole in the body between the tracks and its blades mate with a toothed edge of the carriage so that rotation of the screwdriver will force out or draw in the carriage. When locked, the door casing is applied over the door set device.

5 Claims, 1 Drawing Sheet

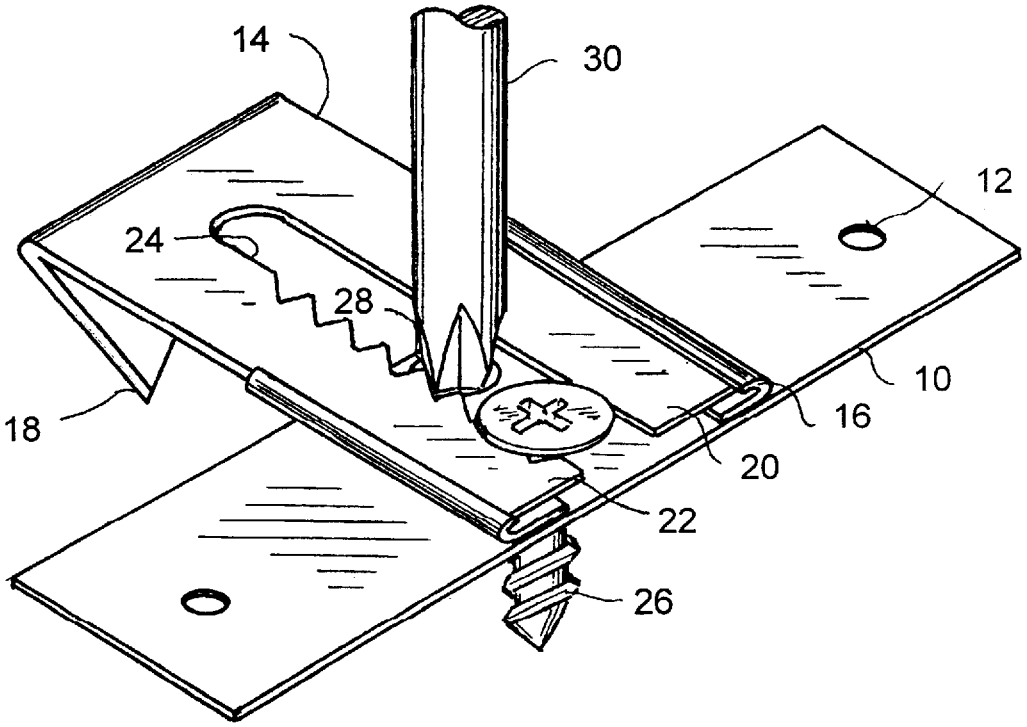
14
30
12
24
28
10
18
16
20
22
26

DOOR-SET DEVICE

This application is a continuation of application Ser. No. 08/748,030, filed Nov. 12, 1996.

SUMMARY OF THE INVENTION

This invention relates to builder's hardware and in particular to a novel device for accurately and quickly adjusting the jambs of pre-hung doors without the use of shingles or shims.

Nearly all new residential doors are supplied hinged to one side of the doorjamb. This unit must be set into a rough wall opening and then adjusted for plumb and correct tolerance between the door and jamb before a casing is applied. This adjustment heretofore has generally been done by wedging shingles between the jamb and the studs forming the rough opening while holding a carpenter's level against the jamb. When the jamb is finally straight and plumb, it is nailed to the studs through the shingle wedges and the protruding ends of the shingles are broken off and discarded. It takes a skilled carpenter over half an hour to accurately install a pre-hung door.

There are many mechanical substitutes for the shingle wedges, most using screws to accurately force apart the jamb from the adjacent studs of the opening until they are plumb and straight until they are permanently secured. The adjustment screws are then removed prior to applying the door casing. Very little time is saved by using this method of installing a pre-hung door.

SUMMARY OF THE INVENTION

This invention is for a small, inexpensive door jamb adjuster which may be used to adjust a door jamb in approximately three minutes. The two-piece door jamb adjuster is approximately ⅛ inch thick and is for adjusting the jamb's verticality and the tolerance between jamb and its pre-hung door. The adjuster's two pieces include a carriage that is slideably attached to a body piece for relative movement. The carriage, which is a thin strip of metal or plastic, has an elongated central cutout portion with one inside edge of the cutout having a wavy form somewhat resembling a coarse rack gear. This wavy cutout overlies a portion of a tapered hole in the body so that the cross shaped blade of a Phillips screwdriver that is held in the hole will mate with the wavy form so that rotation of the screwdriver will force movement between the carriage and body. In effect, the screwdriver becomes a pinion for a coarse rack gear.

One piece of the two piece adjuster is attached to the door jam and the other to the adjacent stud of the door frame. With a carpenter's level being held against the door jam, a Phillips screwdriver is pressed into the tapered hole in the body of the door set device so that the blades of the screwdriver engage the wavy configuration near the center of the carriage. The screwdriver is then turned either clockwise or counterclockwise to either draw together or force apart the doorjamb from the adjacent stud in order to acquire a plumb doorjamb. When verticality is achieved, tightening a set screw in the body of the door set device will lock the carriage to the body. The door casing may then be attached, covering the locked door set device. No shingles or other shims are necessary to install a pre-hung door with the door set device.

To adjust the correct tolerance between the jamb and door, it may be necessary to use several door set devices on each jamb.

DESCRIPTION OF THE DRAWINGS

In the drawings which illustrates the preferred embodiment of the invention:

The single FIGURE is a perspective view of the door set device illustrated with an adjusting Phillips screwdriver.

DETAILED DESCRIPTION OF THE PREFERRED EMBODIMENT

The door set device is an adjusting device to be used by carpenters for plumb adjusting door jambs or pre-hung doors which are to be set into rough wall openings. As illustrated in the drawing, the door set device includes an elongated body 10 about three inches in length with nailing holes 12 at each end for securing the body to the vertical stud of the rough opening. Approximately centered in the body 10 and movable across the body at a right angle to its length is an elongated carriage 14, about two inches in length and ¾ inch in width, which is slideable in tracks 16 attached to the body, as shown.

One end of the carriage 14 is to be attached to a doorjamb. This may be by nails, if desired, but in the preferred embodiment the end of the material of the carriage is bent down and cut into a point 18 which is hammered into the wood of a doorjamb.

The carriage from the end opposite point 18 to a point near the bend to the point 18 is formed into two separated legs 20 and 22, each leg being approximately ¼ inch in width. One the legs 20 has smooth, parallel edge surfaces; the other has a smooth outer edge surface and an inside or facing edge surface 24 that is scalloped into a sine wave type of configuration having a pitch of approximately ⅛ inch.

Located in the body 10 of the door set device midway between the carriage legs 20, 22 are two holes. One hole in the center of the body is for a wood screw 26 that is tightened to operate as a set screw to engage the legs to secure the carriage against any movement; and one hole 28 is a tapered hole near the edge of the body for centering and holding the cross bladed end of a Phillips screwdriver 30 which, when in position in the hole 28, can engage the scalloped edge of the leg 22 very much as a pinion gear engages a rack gear.

In use, body 10 of one of the door set devices is nailed to a stud of the rough door opening and the sharp point is hammered into the door jam of the pre-hung door. Then, while carefully monitoring the plumb with a carpenter's level, a Phillips screwdriver is inserted into the tapered hole 28 and the scalloped edge 24 of the carriage and turned either clockwise or counterclockwise as needed to either draw together or force apart the jamb and the stud until verticality of the jamb is achieved. Then the set screw 26 is tightened to lock the carriage to the body.

I claim:

1. An adjustment device for adjusting the spacing between two members, said device comprising:

an elongated body with a flat upper surface, said body having a pair of spaced parallel tracks across said surface and a tapered hole substantially centered between said tracks;

an elongated carriage, said carriage formed with first and second legs slideably engaged within said pair of tracks, one of said legs having a smooth exterior edge and a scalloped interior edge that can mate with crossed blades of a Phillips screwdriver forced against said tapered hole;

means for attaching said elongated body to one of said members;

means for attaching said carriage to the other one of said members; and means for locking together said body and said carriage.

2. The adjustment device claimed in claim 1 wherein said means for locking includes a screw hole through said body and centered between said carriage legs for inserting a locking screw to lock said legs to said body.

3. The adjustment device claimed in claim 1 wherein said means for attaching said carriage comprises a sharpened and bent over end portion of said carriage opposite said legs.

4. A door set device for adjusting the verticality of a door jamb against a stud in a rough door opening, said door set device comprising:

an elongated metal strap forming a body, said strap having spaced tracks across its surface and mounting holes for nailing said strap to the stud;

means located between said spaced tracks and near the edge of said strap for centering and holding blades of a Phillips screwdriver;

a carriage member having first and second ends, said carriage member formed of a metal strap with two spaced parallel legs at said first end, said legs being slideably moveable in said tracks, a first one of said legs having smooth parallel edges, a second leg having a smooth exterior edge but a scalloped interior edge for mating with the blade of the Phillips screwdriver, the second end of said strap opposite said pair of legs being pointed and bent for securing said carriage member to the doorjamb; and means for locking together said body and said carriage member.

5. The door set device claimed in claim 4 wherein said means for locking includes a screw in the center of said body and centered between said tracks for clamping said legs against said body.

* * * * *